US005481992A

United States Patent [19]

Fujimura

[11] Patent Number: 5,481,992

[45] Date of Patent: Jan. 9, 1996

[54] EMBROIDERY SEWING MACHINE

[75] Inventor: Chiyo Fujimura, Nagoya, Japan

[73] Assignee: Brother Kogyo Kabushiki Kaisha, Nagoya, Japan

[21] Appl. No.: 199,750

[22] Filed: Feb. 22, 1994

[30] Foreign Application Priority Data

Mar. 1, 1993 [JP] Japan ..... 5-039675

[51] Int. Cl.[6] ..... D05B 21/00; D05C 9/04

[52] U.S. Cl. ..... 112/102.5; 112/277; 112/475.19

[58] Field of Search ..... 112/121.12, 121.11, 112/103, 262.3, 266.1, 78, 2, 453, 456, 457, 458, 102.5, 475.18, 475.19, 275, 277; 364/470

[56] References Cited

U.S. PATENT DOCUMENTS

| | | | |
|---|---|---|---|
| 5,228,403 | 7/1993 | Sugimoto | 112/121.12 |
| 5,319,565 | 6/1994 | Hausammann et al. | 112/121.12 X |
| 5,319,566 | 6/1994 | Kongho et al. | 112/457 X |
| 5,383,413 | 1/1995 | Hayashi | 112/121.12 |
| 5,386,789 | 2/1995 | Futamura et al. | 112/121.12 |

FOREIGN PATENT DOCUMENTS

| | | |
|---|---|---|
| 4-30892 | 2/1992 | Japan . |
| 1394785 | 5/1975 | United Kingdom . |
| 2208325 | 3/1989 | United Kingdom . |

*Primary Examiner*—Peter Nerbun
*Attorney, Agent, or Firm*—Oliff & Berridge

[57] ABSTRACT

An embroidery sewing machine for producing an embroidery pattern in an embroidery area on a work sheet by filling the embroidery area with stitches, including a stitch-forming device having one or more sewing needles each of which carries a needle thread and reciprocates in an axial direction thereof, and a needle-thread catcher which cooperates with the sewing needle to form the stitches into the work sheet; a displacing device which displaces the stitch-forming device and the work sheet relative to each other; and a control device which controls the stitch-forming device and the displacing device so that a predetermined portion of the embroidery area is filled with mixed stitches formed of a plurality of color-different needle threads such that the predetermined portion is seen to have a hue of color different from a hue of color of each of the color-different needle threads.

38 Claims, 11 Drawing Sheets

50a+50ab+50ac=50A
50b+50ab+50bc=50B
50c+50ac+50bc=50C

50a+50ab+50ac=50A
50b+50ab+50bc=50B
50c+50ac+50bc=50C

EMBROIDERY SEWING MACHINE

BACKGROUND OF THE INVENTION

1. Field of the Invention

The present invention relates to an embroidery sewing machine which forms, using a sewing needle carrying a needle thread, an embroidery pattern in an embroidery area on a work sheet by displacing the sewing needle and the work sheet relative to each other.

2. Related Art Statement

There is known an embroidery sewing machine which forms an embroidery pattern by utilizing control data stored in a read only memory (ROM) card. The control data include sewing data for sewing the embroidery pattern on a work sheet, and display data for displaying a symbol or icon representing the pattern on a display for selection of the pattern by a user. The ROM card is set in a data-reading device of the sewing machine, so that the display data are used to display the pattern on the display for selection thereof by the user and, upon selection of the pattern, the sewing data are read in by the sewing machine for being used to embroider the pattern into the work sheet.

Japanese Patent Application laid open for public inspection under Publication No. 4(1992)-30892 discloses an embroidery sewing machine which forms, on a work sheet, an embroidery pattern by filling each of a plurality of blocks as divisions of an embroidery area in which the pattern is formed, with stitches formed using a corresponding one of a plurality of different needle threads having different colors. Thus, the sewing machine is capable of producing an embroidery pattern in a variety of color schemes or designs. Since, however, use of an increased number of color-different needle threads leads to lowering work efficiency because of increased work of changing the needle threads, the number of needle threads used is limited to at most five in the conventional sewing machine.

In the case where five color-different needle threads are used in the above-identified embroidery sewing machine, at most six colors, including the color of the work sheet, may be produced in an embroidery pattern. Thus, the sewing machine suffers from insufficient capability of expression of an embroidery pattern. Furthermore, if an embroidery pattern needing seven or more color-different needle threads is formed using only five needle threads only, the thus formed embroidery pattern may be perceived as a different one by the user or others.

SUMMARY OF THE INVENTION

It is therefore an object of the present invention to provide an embroidery sewing machine which produces an embroidery pattern in an embroidery area on a work sheet such that a part or an entirety of the pattern enjoys a color arrangement as desired or imaged by a user.

It is a particular object of the present invention to provide an embroidery sewing machine which produces an embroidery pattern in an embroidery area by filling a part or an entirety of the embroidery area with mixed stitches formed of a plurality of color-different needle threads such that the part or entirety of the embroidery area is seen to have a hue of color different from a hue of color of each of the color-different needle threads.

According to a first aspect of the present invention, there is provided an embroidery sewing machine for producing an embroidery pattern in an embroidery area on a work sheet by filling the embroidery area with stitches, comprising (a) a stitch-forming device including at least one sewing needle each of which carries a needle thread and reciprocates in an axial direction thereof, and a needle-thread catcher which cooperates with the sewing needle to form the stitches into the work sheet, (b) a displacing device which displaces at least one of the stitch-forming device and the work sheet to form the stitches, and (c) a control device which controls the stitch-forming device and the displacing device so that a predetermined portion of the embroidery area is filled with mixed stitches formed of a plurality of color-different needle threads such that the predetermined portion is seen to have a hue of color different from a hue of color of each of the color-different needle threads.

In the embroidery sewing machine constructed according to the first aspect of the present invention, a predetermined part or entirety of an embroidery pattern is sewn by being filled with mixed stitches formed of a plurality of color-different needle threads. Therefore, the part or entirety of the pattern is seen by a user or others such that it has a hue of color different from a hue of color of each of the needle threads used. Thus, the part or entirety of the embroidery pattern can enjoy a variety of color arrangements, i.e., be sewn in any color desired or imaged by the user. Since the present sewing machine is capable of producing much greater a number of colors than the number of the needle threads used, without increasing the work of changing the needle threads, the sewing machine forms embroidery patterns with improved efficiency. The embroidery sewing machine may be either a domestic sewing machine having a single sewing needle, or an industrial sewing machine having a plurality of sewing needles which carry color-different needle threads, respectively, and which are automatically changed with each other to form stitches. The displacing device may displace one of the stitch-forming device and the work sheet relative to the other, or both of them relative to each other.

In a preferred embodiment according to the first aspect of the present invention, the control device comprises means for controlling the stitch-forming device and the displacing device so that underlying stitches are formed in the predetermined portion of the embroidery area with a first one of the plurality of color-different needle threads and subsequently overlying stitches are formed over the underlying stitches with a second one of the color-different needle threads such that the underlying stitches are seen through the overlying stitches.

In another embodiment according to the first aspect of the present invention, the control device comprises means for controlling the stitch-forming device and the displacing device so that underlying stitches are formed in the predetermined portion of the embroidery area with a first one of the plurality of color-different needle threads and subsequently overlying stitches are formed over the underlying stitches with a second one of the color-different needle threads such that an amount of the second needle thread used to form the overlying stitches is less than an amount of the first needle thread used to form the underlying stitches. The amount of the first or second needle thread may be either a length thereof used to form stitches, or a number of stitches formed therewith. Alternatively, it is possible that the amount of the second needle thread used be equal to the amount of the first needle thread.

In yet another embodiment according to the first aspect of the present invention, the control device comprises means for controlling the stitch-forming device and the displacing device so that underlying stitches are formed in the predetermined portion of the embroidery area with a first one of the plurality of color-different needle threads and subsequently overlying stitches are formed over the underlying stitches with a second one of the color-different needle threads such that the overlying stitches are formed by penetrating, with the sewing needle, stitch positions at least a portion of which are different from stitch positions penetrated to form the underlying stitches. That is, either a portion or an entirety of the stitch positions penetrated to form the overlying stitches are different from those penetrated to form the underlying stitches. In this case, the amount of the second needle thread used to form the overlying stitches may be substantially equal to the amount of the first needle thread used to form the underlying stitches. Alternatively, it is possible that all the stitch positions penetrated to form the overlying stitches be the same as a portion or an entirety of those penetrated to form the underlying stitches.

According to a preferred feature of the first aspect of the present invention, the embroidery sewing machine further comprises a data memory in which control data are stored, the control device comprising means for controlling, according to the control data, the stitch-forming device and the displacing device so that the predetermined portion of the embroidery area is filled with the mixed stitches.

According to another feature of the first aspect of the present invention, the control data stored in the data memory comprise sewing data, the control device comprising means for controlling, according to the sewing data, the stitch-forming device and the displacing device to form first stitches in the predetermined portion of the embroidery area with a first one of the plurality of color-different needle threads and controlling, according to the sewing data, the stitch-forming device and the displacing device to form second stitches in the predetermined portion of the embroidery area with a second one of the color-different needle threads, the mixed stitches comprising the first and second stitches. In this case, the stitch positions penetrated to form the second stitches are completely the same as those penetrated to form the first stitches, and the amount of the second needle thread used to form the second stitches is equal to that of the first needle thread used to form the first stitches. However, the predetermined portion of the embroidery area filled with the mixed stitches may be seen to have a hue of color different from that of each of the first and second needle threads, e.g., depending upon the angle of view of the user or others with respect to the embroidery area on the work sheet.

According to yet another feature of the first aspect of the present invention, the control data stored in the data memory comprise first sewing data and second sewing data different from the first sewing data, the control device comprising means for controlling, according to the first sewing data, the stitch-forming device and the displacing device to form first stitches in the predetermined portion of the embroidery area with a first one of the plurality of color-different needle threads and controlling, according to the second sewing data, the stitch-forming device and the displacing device to form second stitches in the predetermined portion of the embroidery area with a second one of the color-different needle threads, the mixed stitches comprising said first and second stitches. The mixed stitches may further comprise stitches formed of one or more needle threads different from the first and second needle threads.

According to a further feature of the first aspect of the present invention, the control means comprises color changing means for changing a first one of the plurality of color-different needle threads to a second one of the color-different needle threads, the control data comprising color-change command data to operate the color changing means. The color changing means may comprise stopping means for stopping the stitch-forming device and the displacing device, the color-change command data comprising stop command data to operate the stopping means to stop the stitch-forming device and the displacing device so as to permit the first needle thread to be changed to the second needle thread. The color changing means may further comprise a display device, the color-change command data further comprising display command data to operate the display device to indicate that it is necessary to change the needle thread carried by the sewing needle. In this case, when the user reads the indication on the display, he or she changes by hand the first needle thread to the second needle thread. Meanwhile, in the case where the at least one sewing needle comprises a plurality of sewing needles carrying color-different needle threads, respectively, the color changing means may automatically change a first sewing needle carrying the first needle thread with a second sewing needle carrying the second needle thread according to needle-change data included in the color-change command data. The color changing means may comprise starting means for starting the stitch-forming device and the displacing device after the first needle thread has been changed to the second needle thread. The color changing means may comprise a manually operable device which is manually operable to operate the starting means to start the stitch-forming device and the displacing device. Alternatively, the color changing means may automatically operate the starting means after the first sewing needle with the first needle thread has automatically been changed with the second sewing needle with the second needle thread.

According to another feature of the first aspect of the present invention, the control data stored in the data memory comprise at least two of (a) first thread-amount data indicative of a first amount of a first one of the plurality of color-different needle threads used to form underlying stitches in the predetermined portion of the embroidery area, (b) second thread-amount data indicative of a second amount of a second one of the color-different needle threads used to form overlying stitches over the underlying stitches in the predetermined portion of the embroidery area, and (c) total thread-amount data indicative of a total amount of the first and second needle threads used to form the mixed stitches consisting of the underlying and overlying stitches. The second amount may be less than the first amount. Alternatively, the second amount may be equal to the first amount. In the case where the control data stored in the data memory comprise the first and second thread-amount data, the first thread-amount data may comprise first stitch-density data indicative of a first number of the underlying stitches formed in a unit length, and the second thread-amount data may comprise second stitch-density data indicative of a second number of the overlying stitches formed in the unit length. The second number is, e.g., four stitches per one mm while the first number is, e.g., two stitches per one mm. Alternatively, it is possible that the first stitch-density data be indicative of a first pitch of formation of the underlying stitches and the second stitch-density data be indicative of a second pitch of formation of the overlying stitches formed. The second pitch is, e.g., 0.25 mm while the first pitch is, e.g., 0.5 mm.

According to another feature of the first aspect of the present invention, the control data stored in the data memory comprise the first and second thread-amount data and outline data indicative of an outline of the predetermined portion of the embroidery area, the control means comprising means for producing, according to the outline data and each of the first and second thread-amount data, stitch position data indicative of stitch positions which are penetrated by the sewing needle to form corresponding ones of the underlying stitches and the overlying stitches. In the case where the outline of the predetermined portion of the embroidery area is defined by a polygon such as a triangle or a quadrangle, the outline data indicative of the polygonal outline may include sets of position data indicative of respective positions of the vertices of the polygon.

According to another feature of the first aspect of the present invention, the embroidery sewing machine further comprises a thread-amount-data input device which is operable to input at least one of the first, second and total thread-amount data.

According to another feature of the first aspect of the present invention, the embroidery sewing machine further comprises a data storing device which stores, in the data memory, the control data including the at least one of the first, second and total thread-amount data inputted by operating the thread-amount-data input device. The data storing device may comprise a manually operable device which is manually operable to store, in the data memory, the control data including the at least one of the first, second and total thread-amount data inputted by operating the thread-amount-data input device. Alternatively, the storing device may automatically store the control data in the data memory in response to the input operation of the thread-amount-data input device.

According to another feature of the first aspect of the present invention, the control data stored in the data memory comprise direction data, the control device comprising means for controlling, according to the direction data, the stitch-forming device and the displacing device to form the overlying stitches each of which extends parallel to the underlying stitches adjacent to the each overlying stitch. In this case, the underlying stitches give a more distinct impression than the overlying stitches. Alternatively, it is possible that each of the overlying stitches be formed to cross (e.g., extend perpendicular to) the underlying stitches adjacent to the each overlying stitch. In the latter case, the overlying stitches may give a stronger impression than the underlying stitches.

It is a second object of the present invention to provide a process of producing an embroidery pattern in an embroidery area on a work sheet such that a part or an entirety of the embroidery pattern enjoys a color arrangement as desired or imaged by a user.

According to a second aspect of the present invention, there is provided a process of producing an embroidery pattern in an embroidery area on a work sheet by filling the embroidery area with stitches, comprising the steps of storing, in a data memory, control data to control an embroidery sewing machine so that a predetermined portion of the embroidery area is filled with mixed stitches formed of a plurality of color-different needle threads such that the predetermined portion is seen to have a hue of color different from a hue of color of each of the color-different needle threads; and producing the embroidery pattern on the work sheet by filling the embroidery area with the mixed stitches formed by controlling the embroidery sewing machine according to the control data stored in the data memory.

It is a third object of the present invention to provide an apparatus for producing control data to control an embroidery sewing machine and utilizing the control data to form an embroidery pattern in an embroidery area on a work sheet such that a part or an entirety of the embroidery pattern enjoys a color arrangement as desired or imaged by a user.

According to a third aspect of the present invention, there is provided an apparatus for producing control data to control an embroidery sewing machine and utilizing the control data to form an embroidery pattern in an embroidery area on a work sheet by filling the embroidery area with stitches, comprising a data producing device which produces the control data to control the embroidery sewing machine so that a predetermined portion of the embroidery area is filled with mixed stitches formed of a plurality of color-different needle threads such that the predetermined portion is seen to have a hue of color different from a hue of color of each of the color-different needle threads, and a data utilizing device which utilizes the control data so that the predetermined portion of the embroidery area is filled with the mixed stitches.

According to a preferred feature of the third aspect of the invention, the data utilizing device comprises a stitch-forming device of the embroidery sewing machine which forms the mixed stitches according to the control data.

According to another feature of the third aspect of the invention, the data utilizing device comprises an external memory in which the control data are stored. The external memory may comprise a random access memory (RAM) card which is removable from the apparatus for use with the embroidery sewing machine independent of the apparatus.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings in which.

DETAILED DESCRIPTION OF THE PREFERRED EMBODIMENTS

Figure 1:
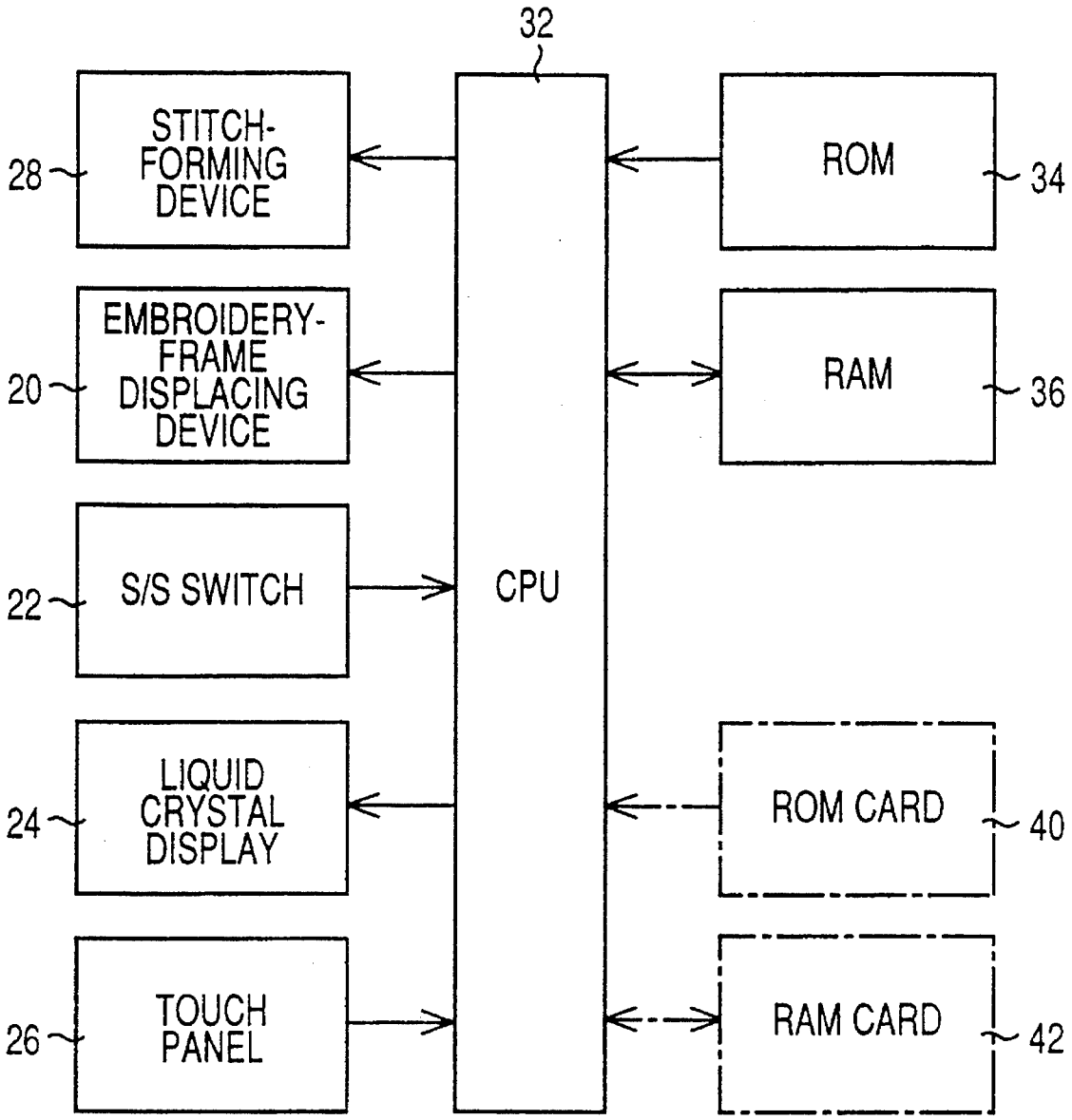
FIG. 1 is a diagrammatic view of an electric construction of an embroidery sewing machine embodying the present invention.

Referring first to FIG. 1, there is illustrated an embroidery sewing machine embodying the present invention.

The present embroidery sewing machine includes a control device which is essentially constituted by a computer including a central processing unit (CPU) 32, and an internal read only memory (ROM) 34 and an internal random access memory (RAM) 36 which constitute an internal data-storage device. The internal ROM 34 has respective memory sections for storing control data and control programs which are used to control the embroidery sewing machine. The control data include sets of display data for displaying symbols or icons representing embroidery patterns on a liquid-crystal display 24 provided on the front surface of the arm (not shown) of the sewing machine, and sets of sewing data for sewing the embroidery patterns on a work sheet (not shown) such as a cloth or a leather supported by the embroidery frame (not shown) of the sewing machine. The control programs include a program for displaying and sewing the embroidery patterns. The program is represented by the flow charts of FIGS. 3 and 4. The internal RAM 36 has a memory section for temporarily storing data produced from data processing of the CPU 32. The CPU 32 is adapted to read in the control data from the internal ROM 34 and store the control data in the internal RAM 36.

By operating memory select switches (not shown), the CPU 32 reads in similar control data from an external ROM 40 or an external RAM 42 (indicated in broken line in FIG. 1) which constitute an external data-storage device, and stores the control data in the internal RAM 36. In the present embodiment, the external ROM 40 and RAM 42 are provided in the form of cards or cassettes which can be set in, and removed from, the present sewing machine. The ROM and RAM cards are described in detail in U.S. patent application No. 08/103,661 filed Aug. 10, 1993 assigned to the Assignee of the present application. In the following description, the internal ROM 34, external ROM 40, and external RAM 42, each of which stores control data including sewing data and display data, are referred to as the data-storage medium where appropriate.

Figure 5:
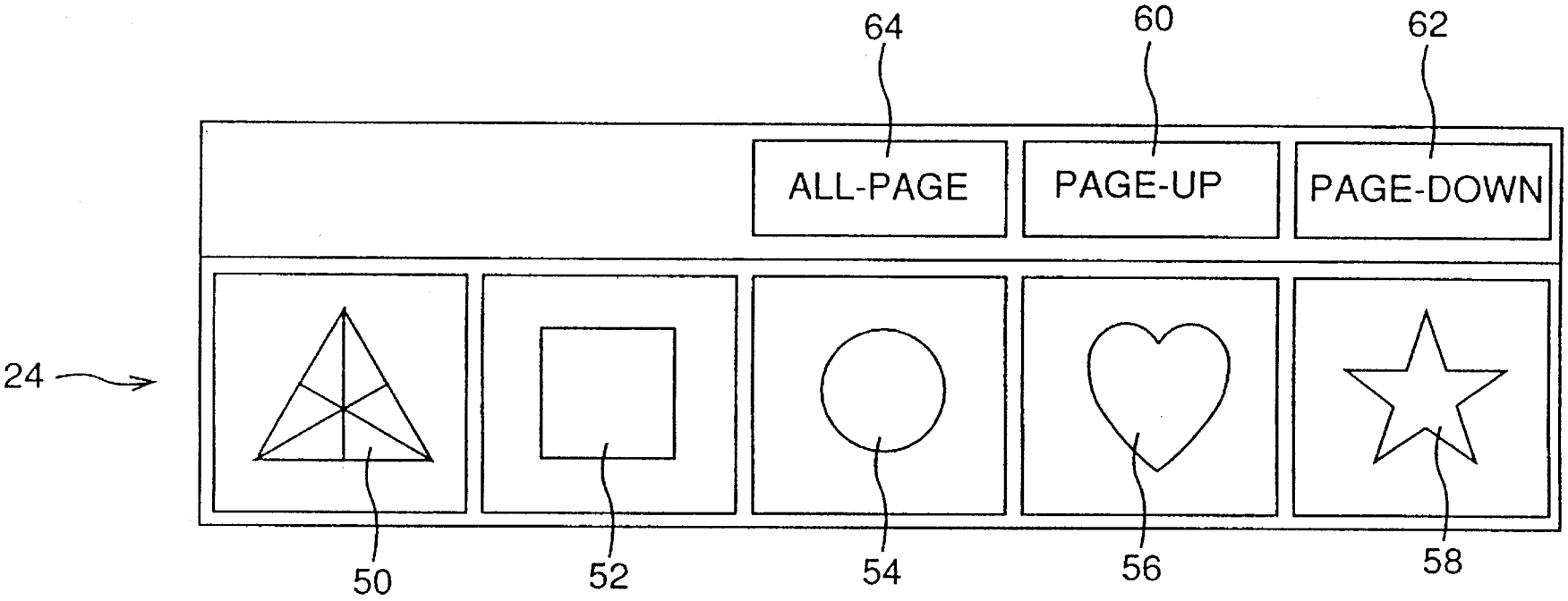
FIG. 5 is a view of an embroidery-pattern image displayed on a liquid-crystal display of the sewing machine of FIG. 1 which image permits a user to select a desired one of a plurality of embroidery patterns included in the image.

According to the sets of display data stored in the internal RAM 36, the CPU 32 controls the liquid-crystal display 24 to display a page or band of embroidery patterns 50–58 (i.e., icons representing the patterns) as shown in FIG. 5. A touch panel 26 is provided on the top surface of the display 24. When user's finger touches or presses an appropriate part of the panel 26 which corresponds to a desired one of the embroidery patterns indicated on the display 24, the CPU 32 identifies the selected one of the embroidery patterns. According to the set of sewing data for the selected embroidery pattern, the CPU 32 drives the main motor (not shown) of the sewing machine to reciprocate a sewing needle (not shown) supported at the end of the arm of the sewing machine and simultaneously rotate a needle-thread catcher (not shown) provided in the bed (not shown) of the sewing machine so that the sewing needle and the needle-thread catcher cooperate with each other to form stitches into the work sheet supported by the embroidery frame. The sewing needle and the needle-thread catcher cooperate with the main motor to provide a stitch-forming device 28. Additionally, the CPU 32 drives an embroidery-frame displacing device 20 to displace the work sheet supported by the embroidery frame, relative to the sewing needle and needle-thread catcher, i.e., stitch-forming device 28. The sewing needle carries a color needle thread selected and mounted by the user. In the present embodiment, the "color" of the needle thread is defined as including an achromatic color such as white, gray, or black as well as a chromatic color such as yellow, blue, or red.

Upon operation or depression of a start/stop (S/S) switch 22 provided in the front surface of the arm of the sewing machine, the CPU 32 commands, according to the set of sewing data stored in the internal RAM 36, the stitch-forming device 28 and the embroidery-frame displacing device 20 to start the formation of the selected embroidery pattern. Upon reading color-change data included in the sewing data (FIG. 9), the CPU 32 automatically commands the stitch-forming device 28 and the embroidery-frame displacing device 20 to stop the formation of the selected embroidery pattern and automatically commands the display 24 to display a message indicating that it is necessary to change the needle thread carried by the sewing needle. In response to the indication, the user changes by hand the current needle thread having a certain color with another thread having a different color. Meanwhile, upon reading sewing-end data included in the sewing data (FIG. 9), the CPU 32 automatically commands the sewing machine to end the formation of the selected pattern. Initially, when the user connects the sewing machine to electric power, the CPU 32 reads in, from the internal ROM 34, the control program represented by the flow charts of FIGS. 3 and 4 and controls the sewing machine according to the control program.

Figure 2:
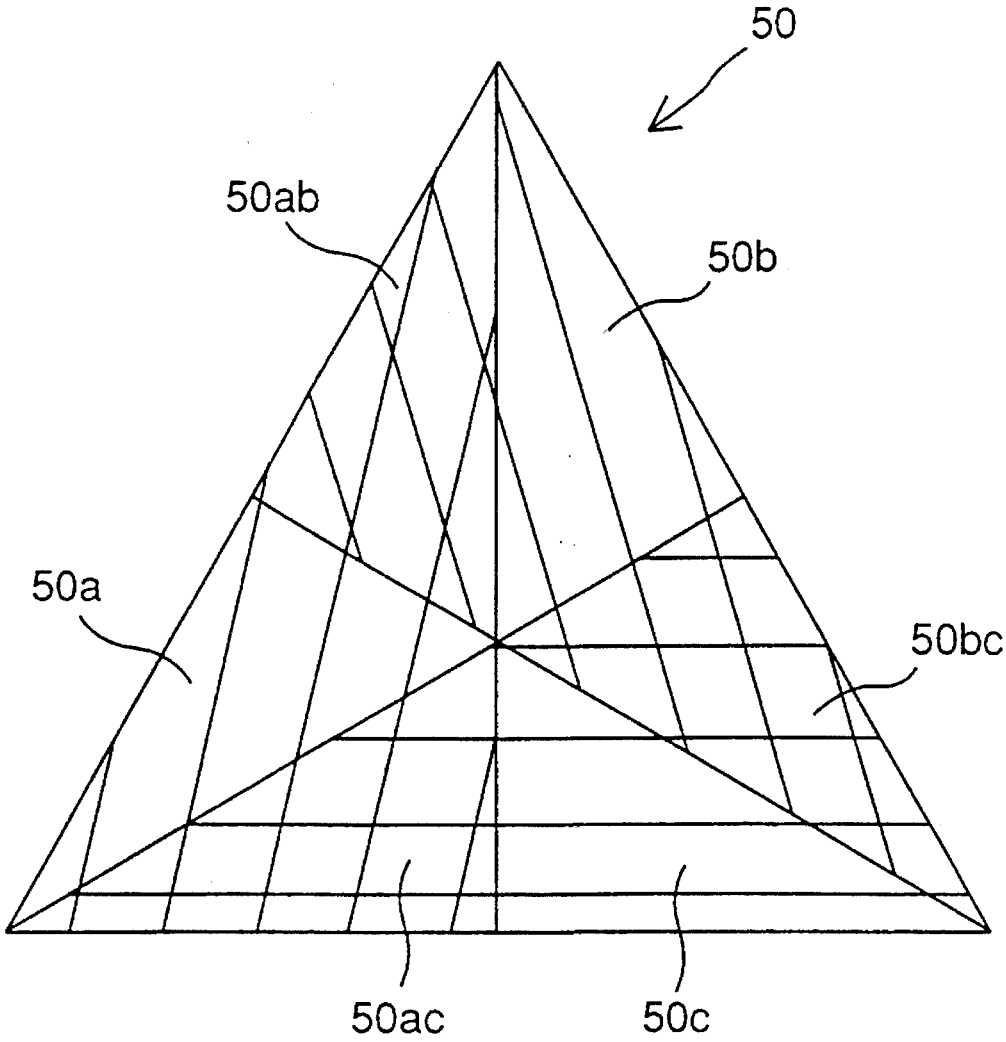
FIG. 2 is a view of an example of an embroidery area in which an embroidery pattern is formed by the sewing machine of FIG. 1.

A set of sewing data for, e.g., an embroidery pattern 50 shown in FIG. 2 includes sets of thread-amount data each of which is indicative of an amount of needle thread used to form stitches in a corresponding one of a plurality of blocks as divisions of an embroidery area in which the embroidery pattern 50 is formed. In the present embodiment, each set of thread-amount data is stitch-density data indicative of a number of stitches formed in unit length (e.g., one mm). However, the stitch-density data may otherwise be indicative of a pitch of formation of stitches, that is, a length in which one stitch is formed. Alternatively, each set of thread-amount data may be stitch-number data indicative of a number of all stitches formed in a corresponding block.

The sewing data for the embroidery pattern 50 additionally includes sets of block data each indicative of the outline of a corresponding block in the embroidery area. In the case where the blocks are polygons such as triangles or quadrangles, each set of block data includes sets of position data indicative of the positions of vertices of the polygonal blocks. The CPU 32 produces, according to the sets of block data and the sets of stitch-density data, stitch position data indicative of stitch positions which are penetrated by the sewing needle to form respective stitches. Moreover, in the present embodiment, the set of sewing data includes sets of same-color area data each indicative of the outline of a corresponding one of a plurality of same-color areas. Each same-color area is filled with stitches formed of a same or single needle thread. Each one of the same-color areas may, or may not, overlap another or other same-color areas inside the outline of the embroidery area. The outline of an overlapping portion of a same-color area is represented by a set of block data. Therefore, in the case where one same-color area overlaps another, each of the two same-color area data for the two same-color areas includes an identical set of block data indicative of the outline of the overlapping portion, i.e., block in which underlying stitches are formed of a needle thread selected for one of the two same-color areas and subsequently overlying stitches are formed of a different needle thread for the other same-color area. Each set of same-color area data includes overlap-judge data indicative of whether or not a corresponding one of the same-color areas includes a portion or portions overlapping another or other same-color areas inside the outline of the embroidery area.

There will be described the operation of the embroidery sewing machine constructed as described above, for producing, e.g., the embroidery pattern 50 of FIG. 2, by reference to the flow charts of FIGS. 3 and 4. The embroidery pattern 50 consists of three same-color areas 50A, 50B, 50C (FIG. 6) each of which is divided into three blocks (50*ac*, 50*a*, 50*ab*), (50*ab*, 50*b*, 50*bc*), or (50*bc*, 50*c*, 50*ac*) as shown in FIG. 2. The block 50*ab* is an overlapping portion of the second same-color area 50B (but not an overlapping portion of the first same-color area 50A); and the blocks 50*ac* and 50*bc* are overlapping portions of the third same-color area 50C. Thus, the first area 50A has no overlapping portion. Assuming that the user uses a yellow, a blue, and a red needle thread for embroidering the three same-color areas 50A, 50B, 50C, respectively, the embroidery pattern 50 is produced on the work sheet with six hues of color, i.e., yellow, green, blue, violet, red, and orange in addition to the background color of the work sheet.

Each of sets of block data indicative of blocks in which stitches are formed directly on the upper surface of work sheet is associated with "normal" stitch-density data indicating that four stitches are formed in unit length of one mm, so that the work sheet inside those blocks become invisible because of the stitches filling the blocks. The normal stitch-density data may be changed depending upon, e.g., the thickness of the needle thread used. On the other hand, each of sets of block data indicative of blocks in which stitches (i.e., overlying stitches) are formed over stitches (i.e., underlying stitches) formed directly on the work sheet in the "normal" stitch-density, is associated with "visible" stitch-density data indicating that two stitches are formed in the unit length of one mm, so that the underlying stitches are visible or seen through the overlying stitches.

Figure 3:
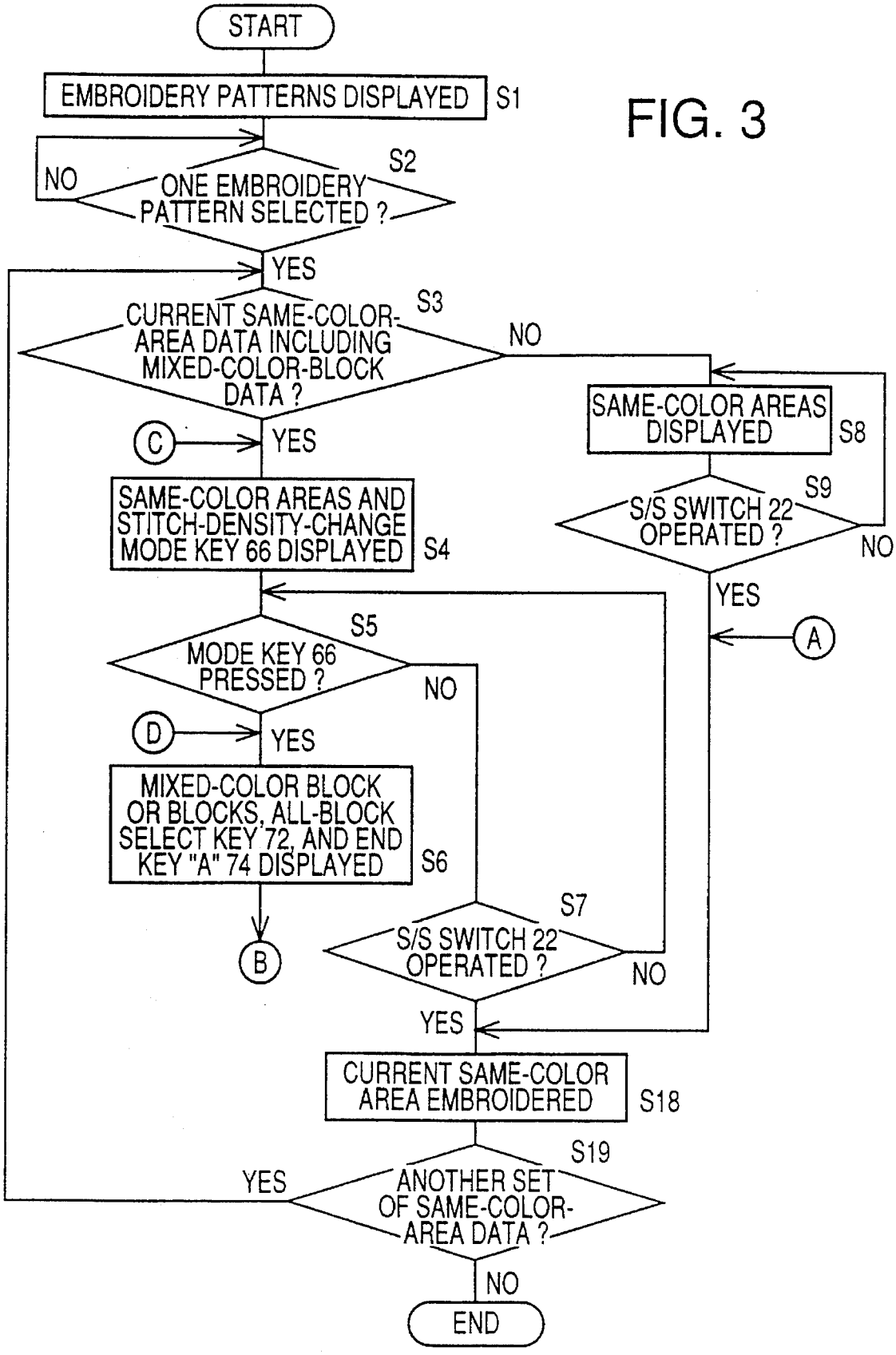
FIG. 3 is a flow chart representing a portion of a control program used by the sewing machine of FIG. 1 to form an embroidery pattern.
Figure 4:
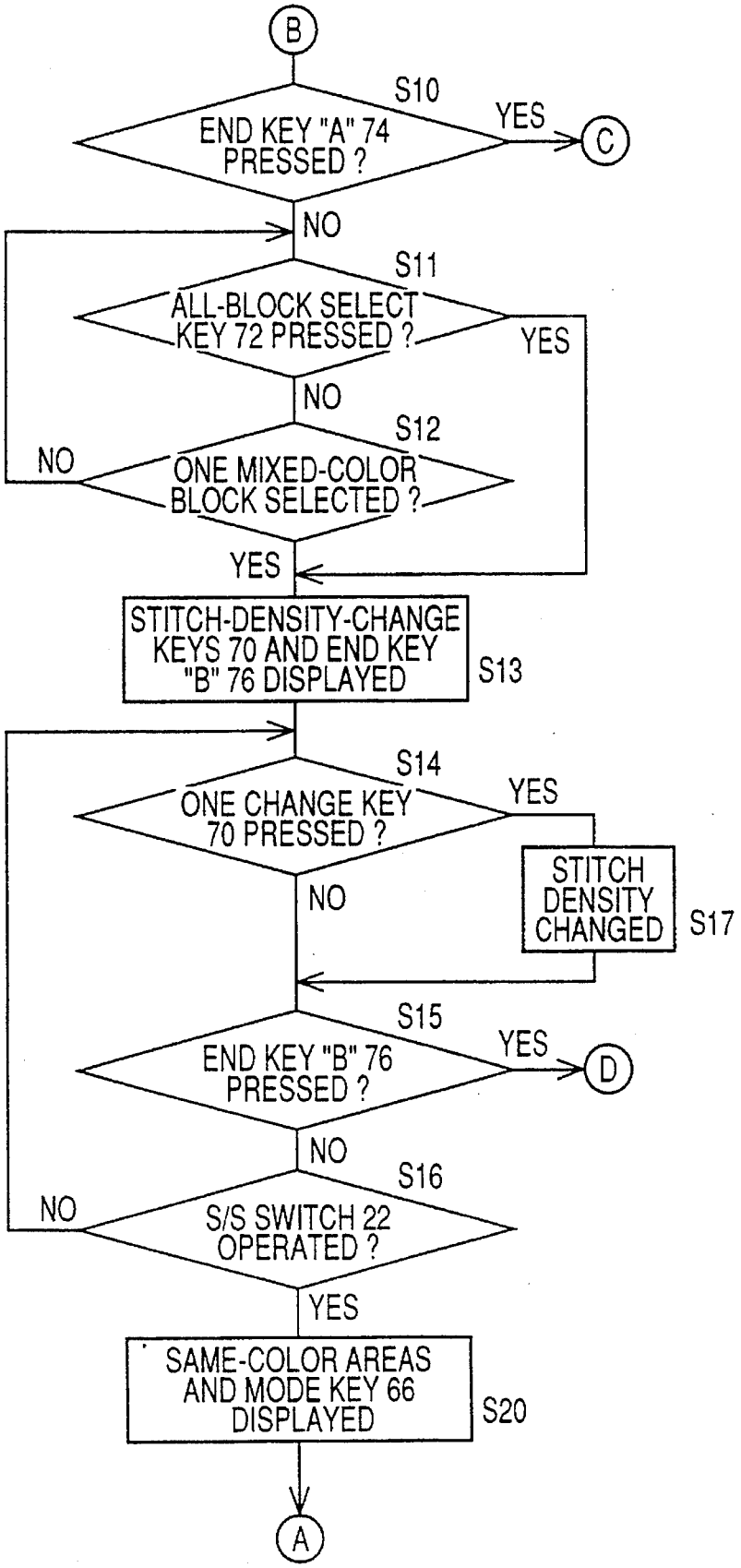
FIG. 4 is a flow chart representing another portion of the control program.

First, at Step S1 of FIG. 3, the CPU 32 commands the liquid-crystal display 24 to display an initial image as shown in FIG. 5. The lower half of the initial image includes a page or band of embroidery patterns 50 to 58 so as to permit the user to select a desired one, while the upper half of the initial image includes a page-up key 60 for displaying a preceding page of patterns in place of the current page, a page-down key 62 for displaying a following page of patterns in place of the current page, and an all-page key 64 for displaying, one after another, all pages of patterns stored in a currently selected one of the internal ROM 34, external ROM 40 card, and external RAM 42 card. Step S1 is followed by Step S2 to judge whether one embroidery pattern has been selected. Assuming that the user selects the pattern 50 from the initial image of FIG. 5 by pressing a part of the touch panel 26 corresponding to the icon representing the pattern 50, a positive judgment is made at Step S2, so that the control data for the selected pattern 50 are read in from the current memory 34, 40, or 42 and stored in the internal RAM 36. While all pages of patterns are displayed one page after another, each page for a predetermined time, in response to operation of the all-page key 64, the user can select a desired pattern by touching the icon corresponding to that pattern. So long as the user does not touch the touch panel 24, the pages are updated till the last page. When one pattern is selected, the updating of the pages is ended. Subsequently, the control of the CPU 32 goes to Step S3 to judge whether a current set of same-color area data includes overlap-judge data indicating that the same-color area represented by the current same-color area data overlaps another or other same-color areas, i.e., one or more sets of "mixed-color" block data each indicative of the outline of a corresponding block in which mixed stitches are formed of a plurality of color-different needle threads. The set of same-color area data for the first same-color area 50A that is sewn first of all the three areas 50A, 50B, 50C includes overlap-judge data indicating that the first area 50A does not overlap any other area 50B or 50C. That is, the current same-color area 50A does not include any mixed-color block and therefore the stitch density is not changed during the embroidering of the area 50A. Thus, regarding the first same-color area 50A, a negative judgment is made at Step S3. In this case, the control of the CPU 32 goes to Step S8 to command the display 24 to indicate the three same-color areas 50A to 50C in the order of embroidering thereof, as seen from the left-hand side end of the display 24 to the right-hand side end thereof, as shown in FIG. 6.

Assuming that the user selects a yellow needle thread for embroidering the first same-color area 50, the user operates the S/S switch 22 after the yellow thread has been passed through the eye of the sewing needle. Thus, a positive judgment is made at Step S9, so that the control of the CPU 32 goes to Step S18 to embroider, on the work sheet, the first same-color area 50A (i.e., blocks 50*a*, 50*ab*, 50*ac*) with the yellow thread according to the normal stitch-density data.

Step S18 is followed by Step S19 to judge whether the CPU 32 has read in color-change data indicating that another set of same-color area data remains for embroidering another same-color area. Regarding the first same-color area 50A, a positive judgment is made at Step S19 since the pattern 50 includes the second same-color area 50B. In this case, the CPU 32 automatically stops the stitch-forming device (i.e., main motor) 28 and the embroidery-frame displacing device 20, automatically commands the display 24 to indicate that it is necessary to change the needle thread carried by the sewing needle, and goes back to Step S3. At Step S3, a positive judgment is made in this control cycle since the same-color area data for the second same-color area 50B (i.e., blocks 50*ab*, 50*b*, 50*bc*) include mixed-color block data indicative of the outline of the mixed-color block 50*ab*. In this case, the control of the CPU 32 goes to Step S4 to command the display 24 to indicate the three same-color areas 50A to 50C and a stitch-density-change mode key 66 as shown in FIG. 6.

Figure 6:
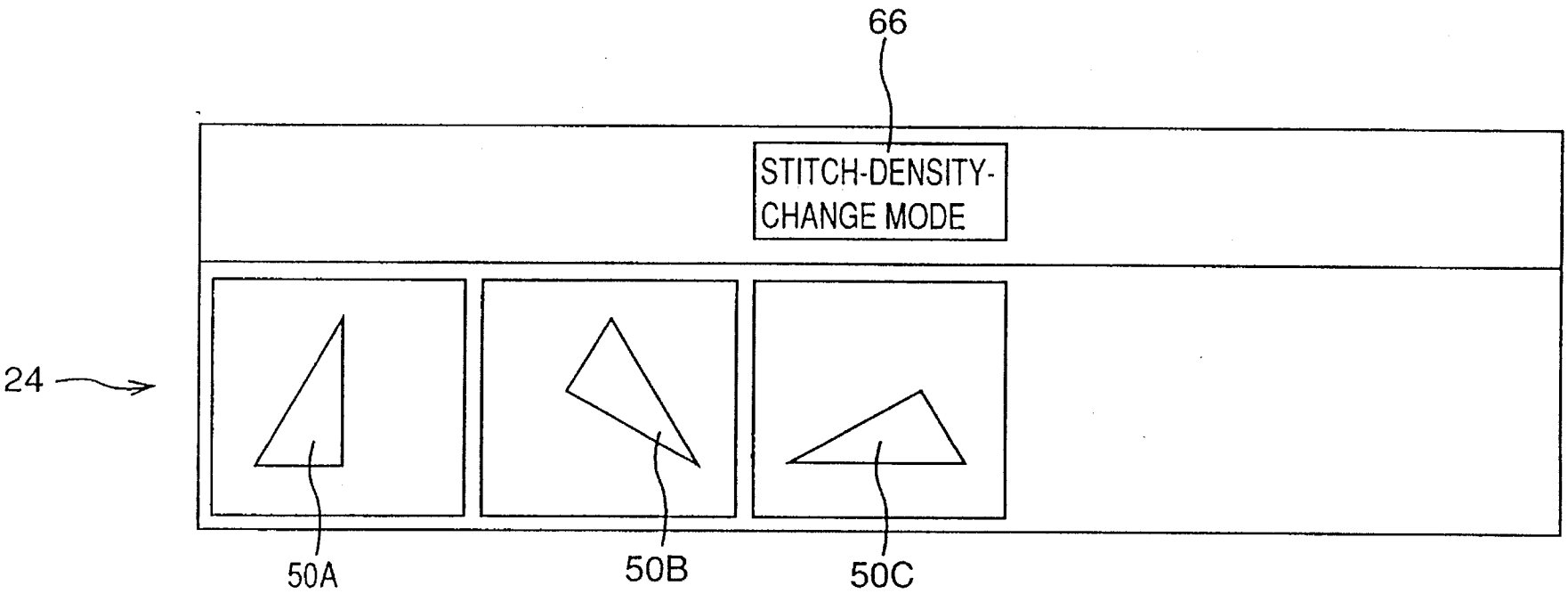
FIG. 6 is a view of a same-color-area image displayed on the sewing machine of FIG. 1 which image permits the user to select a stitch-density-change mode.

With the same-color areas 50A to 50C being indicated on the display 24 as shown in FIG. 6, the user changes the yellow thread currently carried by the sewing needle, with a different thread for embroidering the second same-color area 50B. It is assumed that the yellow thread is changed with a blue thread. Step S4 is followed by Step S5 to judge whether the mode key 66 has been pressed. When the user wants to change the visible stitch-density for the mixed-color block 50*ab*, he or she presses a part of the touch panel 26 corresponding to the mode key 66. In this case, a positive judgment is made at Step S5. On the other hand, when the user presses the S/S switch 22 without pressing the mode key 66, a negative judgment is made at Step S5 and a positive judgment is made at Step S7, so that the control of the CPU 32 goes to Step S18 to form overlying stitches with the blue thread over the yellow-thread underlying stitches in the mixed-color block 50*ab* according to the unchanged visible stitch-density, and subsequently embroider the other blocks 50*b*, 50*bc* with the blue thread according to the normal stitch-density data. The mixed-color block data for the block 50*ab* include direction data indicating that each of the overlying stitches extends substantially parallel to the underlying stitches adjacent thereto.

Step S18 is followed by Step S19. Since the embroidery pattern 50 includes the third same-color area 50C following the second area 50B, the CPU 32 reads in color-change data from the internal RAM 36, so that a positive judgment is made at Step S19. The CPU 32 automatically stops the stitch-forming device 28 and the embroidery-frame displacing device 20, so as to permit the user to change the needle thread carried by the sewing needle. Then, the control of the CPU 32 goes back to Step S3. Thus, the mixed-color block 50*ab* is filled with mixed stitches formed of the yellow and blue needle threads, such that a hue of color of the block 50*ab* is green as a color arrangement of yellow and blue. Thus, the three hues of color, yellow, green, and blue, are produced from the two needle threads, yellow and blue.

Figure 7:
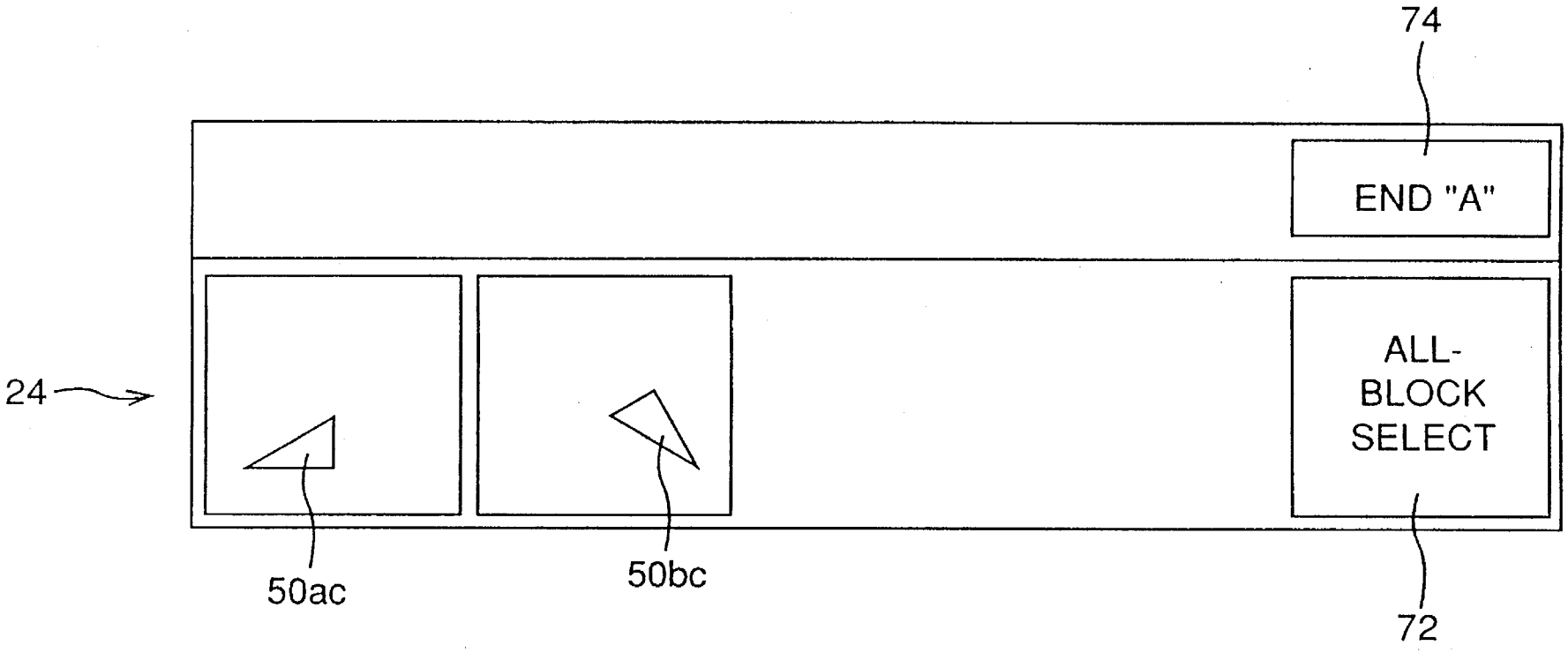
FIG. 7 is a view of a mixed-color-block image displayed on the sewing machine of FIG. 1 which image permits the user to select one or all of the mixed-color block or blocks included in the image.

At Step S3, a positive judgment is made in this control cycle since the same-color area data for the third same-color area 50C (i.e., blocks 50*c*, 50*ac*, 50*bc*) include two sets of mixed-color block data indicative of the respective outlines of the mixed-color block 50*ac* and 50*bc*. Thus, the control of the CPU 32 goes to Step S4 to command the display 24 to indicate the three same-color areas 50A to 50C and the stitch-density-change mode key 66. Assuming that the user presses the mode key 66, a positive judgment is made at Step S5, so that the control of the CPU 32 goes to Step S6 to command the display 24 to indicate the two mixed-color blocks 50*ac*, 50*bc*, an all-block select key 72, and an end key "A" 74 as shown in FIG. 7. When the user wishes to change the standard visible stitch-density data with respect to the block 50*ac*, or the block 50*bc*, or both of the two blocks 50*ac*, 50*bc*, he or she presses a part of the touch panel 26 corresponding to the block 50*ac*, 50*bc*, or key 72, respectively, on the display 24.

Figure 8:
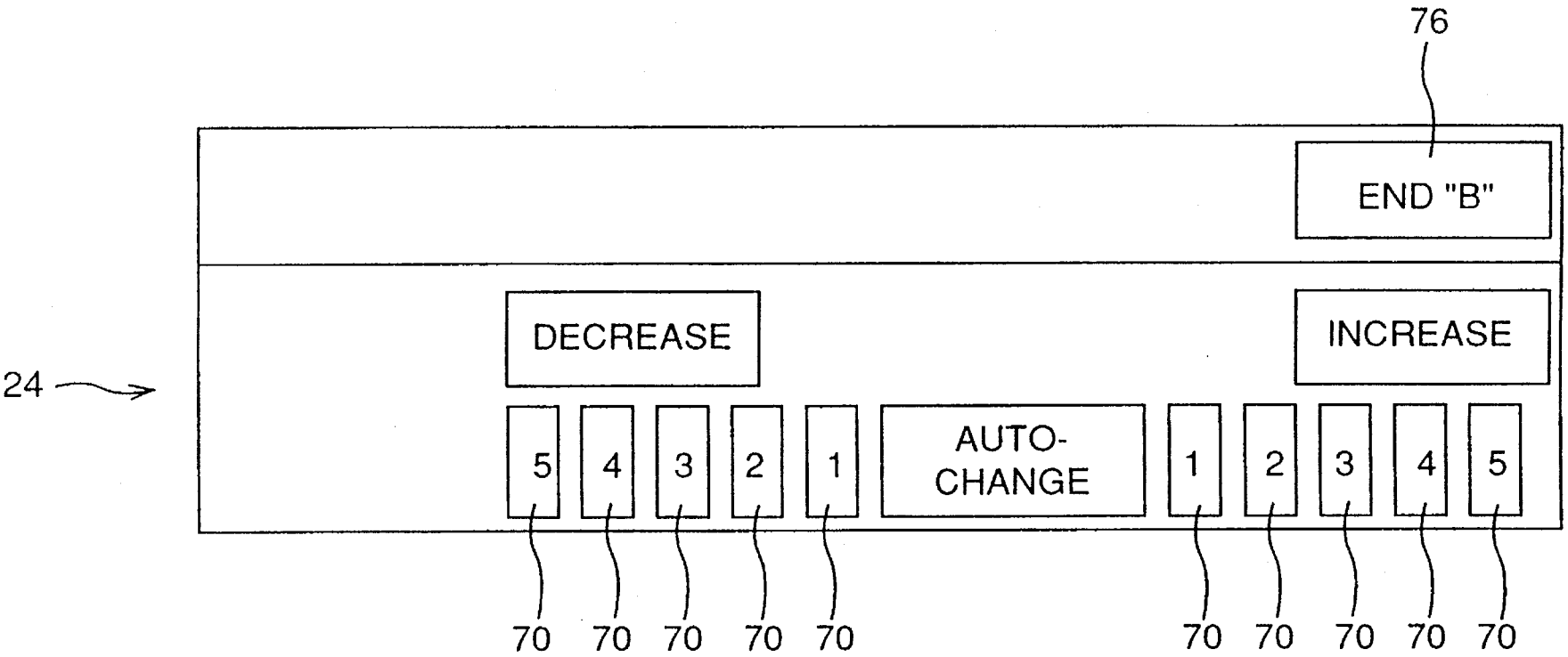
FIG. 8 is a view of a stitch-density-change image displayed on the sewing machine of FIG. 1 which image permits the user to increase or decrease the stitch density of the selected mixed-color block or blocks.

In the case, for example, where the user desires to increase the amount of the red thread used to form overlying stitches in the block 50*ac* so as to give the block 50*ac* a reddish orange color, he or she presses the block 50*ac* in the lower half of the display 24, without pressing the all-block select key 72 or the end key "A" 74 in the upper half of the display 24. In this case, a negative judgment is made at each of Steps S10 and S11 and a positive judgment is made at Step S12. Thus, the control of the CPU 32 goes to Step S13 to command the display 24 to display a number of stitch-density-change keys 70 in the lower half and an end key "B" 76 in the upper half as shown in FIG. 8. The stitch-density change keys 70 correspond to various degrees of stitch density greater or smaller than the standard visible stitch density. Step S13 is followed by Step S14 to judge whether one of the change keys 70 has been pressed. When the user presses, for example, the one-degree (labeled "1") key 70 on the right-hand side half of the image, a positive judgment is made at Step S14 and the control of the CPU 32 goes to Step S17 to increase the standard stitch density to a density greater by one degree. When the user also wishes to change the predetermined visible stitch-density data with respect to the other mix-color block 50*bc*, the user needs to press the end key "B" 76 so that the display 24 backs to the image of FIG. 7. Thus, it is possible to change the standard visible stitch-density for the two blocks 50*ac*, 50*bc* to different densities, respectively. Meanwhile, if the user changes his mind not to modify the visible stitch-density data after he or she has pressed the mode key 66, he or she needs to press the end key "A" 74 in the image of FIG. 7.

It is assumed that, with the image of FIG. 8 being indicated on the display 24, the user operates the S/S switch 22 without pressing any one of the change keys 70 or the end key "B" 76, after the blue thread has been changed with a red thread. In this case, a negative judgment is made at each of Steps S14 and S15 and a positive judgment is made at Step S16, so that the control of the CPU 32 goes to Step S20 to command the display 24 to indicate the image of FIG. 6. Step S20 is followed by Step S18 to form overlying stitches over the yellow-thread underlying stitches with the red thread in the block 50*ac* according to the one-degree increased visible stitch-density data, subsequently form stitches with the red thread in the block 50*c* directly on the work sheet according to the normal stitch-density data, and then form overlying stitches over the blue-thread underlying stitches with the red thread in the block 50*bc* according to the unchanged visible stitch-density data. Each of the overlying stitches formed in each of the blocks 50*ac*, 50*bc* substantially extends parallel to the underlying stitches adjacent thereto.

Figure 9:
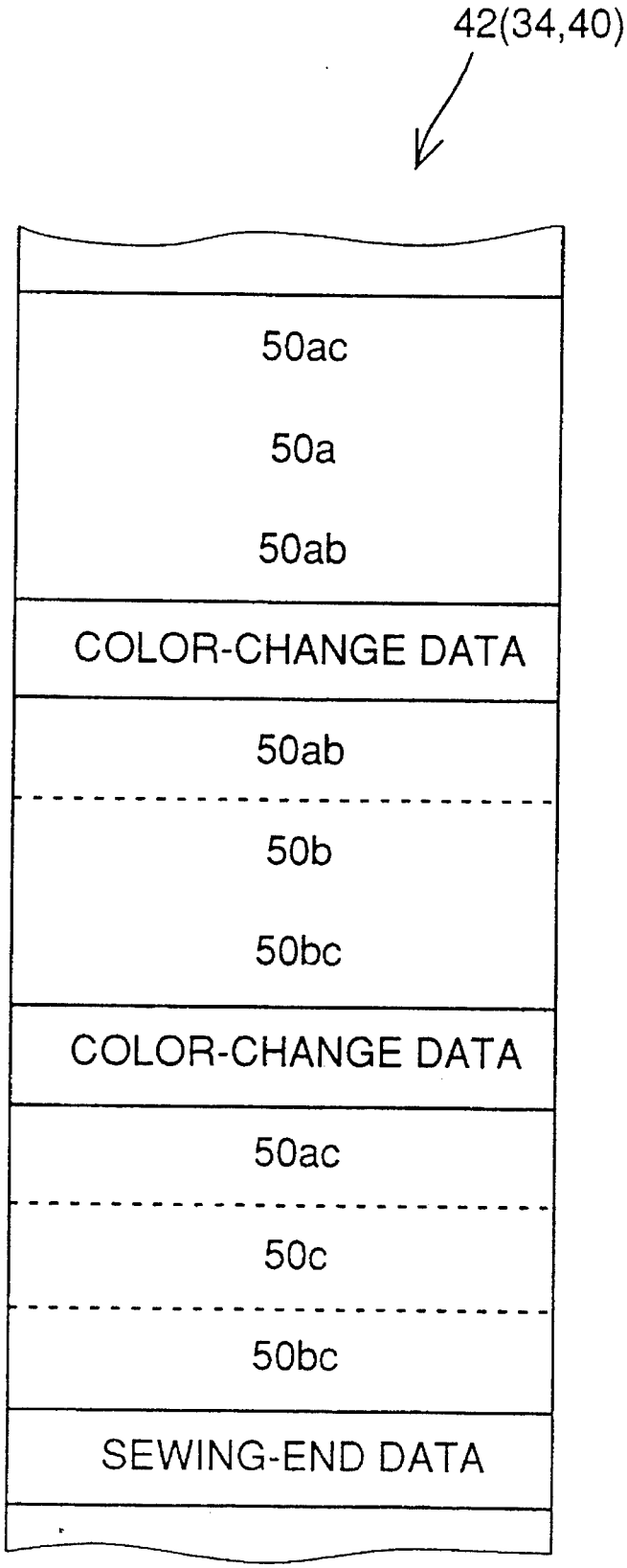
FIG. 9 is an explanatory view of control data stored in, e.g., a random access memory (RAM) card which data are used by the sewing machine of FIG. 1 to form the embroidery pattern of FIG. 2.

Step S18 is followed by Step S19. In this control cycle, the CPU 32 reads sewing-end data from the internal RAM 36, and a negative judgment is made at Step 19, so that the CPU 32 stops the stitch-forming device 28 and the embroidery-frame displacing device 20. Thus, the operation of the present sewing machine according to the flow charts of FIGS. 3 and 4 ends. A portion of the set of sewing data for forming the embroidery pattern 50 is shown in FIG. 9. By operating a manually operable key (not shown) of the sewing machine, it is possible to store, in the RAM card 42, the modified sewing data including the changed visible stitch-density data for the color-mixed block or blocks 50*ab*, 50*ac*, 50*bc*, so that the RAM card 42 is removed from the present sewing machine and is used with a different sewing machine having a data-reading device capable of reading the sewing data from the RAM card 42. The CPU 32 may be adapted to automatically store, in the RAM card 42, the modified sewing data including the changed visible stitch-density data upon operation of the stitch-density-change keys 70.

The mixed-color block 50*ac* is filled with mixed stitches formed of the yellow and red threads, such that a hue of color of the block 50*ac* is reddish orange as a color arrangement of yellow and red, while the mixed-color block 50*bc* is filled with mixed stitches formed of the blue and red needle threads, such that a hue of color of the block 50*bc* is violet as a color arrangement of blue and red. Therefore, the embroidery pattern 50 is formed with the three color-different needle threads, yellow, blue, and red, such that the pattern 50 is given six hues of color, yellow, green, blue, violet, red, and reddish orange. Thus, the pattern 50 is embroidered with an increased number of hues of color as compared with the conventional manner wherein each block is filled with stitches formed of a single or same needle thread. Since the number of changing of the needle threads is not increased, the labor necessary to change the needle threads is largely reduced for the increased number of colors.

Since the standard visible stitch-density data is easily changeable, the hue of color of stitches formed in a mixed-color block is not limited to, e.g., orange but can finely be adjusted to a desired color, e.g., reddish orange. Thus, the present sewing machine is vary versatile with respect to the color expression of an embroidery pattern.

A set of mixed-color block data may include gradation data to control the stitch-forming device 28 and the embroidery-frame displacing device 20 to form overlying stitches such that the stitch-density of the overlying stitches gradually increases as the overlying stitches are formed over underlying stitches in a corresponding mixed-color block of an embroidery area. In this case, a pattern in which the hue of color changes by gradation, i.e., "gradation" pattern is formed with only two color-different needle threads. Thus, the present sewing machine contributes to largely reducing the labor conventionally necessary to produce a "gradation" pattern using, by changing one after another, various color-different needle threads including one with a starting color, one with an ending color, and one or ones with intermediate colors. Otherwise, mixed-color block data may include stepwise-change data to form overlying stitches in stitch densities variable in steps.

In the case where a mixed-color block is filled with mixed stitches, i.e., underlying and overlying stitches formed of two color-different needle threads, the color of the underlying stitches more effectively defines the block than that of the overlying stitches formed in the visible stitch density. Therefore, it is preferred that the underlying stitches be formed with a color thread with which the user desires to define the mixed-color block.

Figure 10:
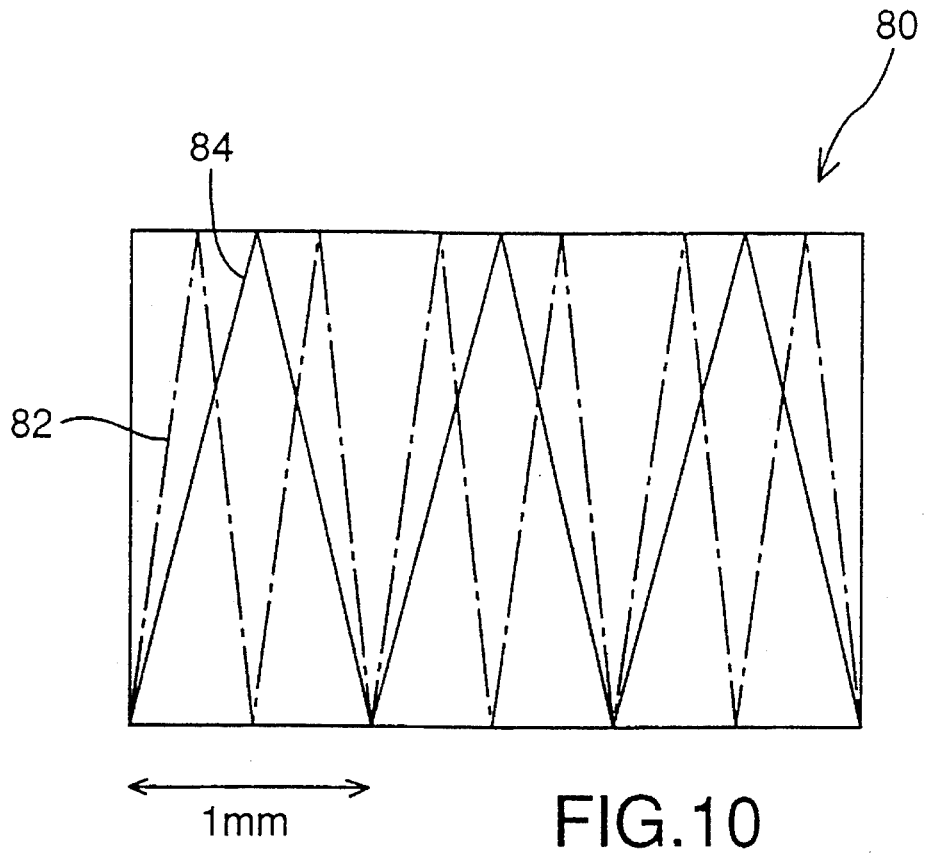
FIG. 10 is a view of a mixed-color block sewn with two color-different needle threads by the sewing machine of FIG. 1.
Figure 11:
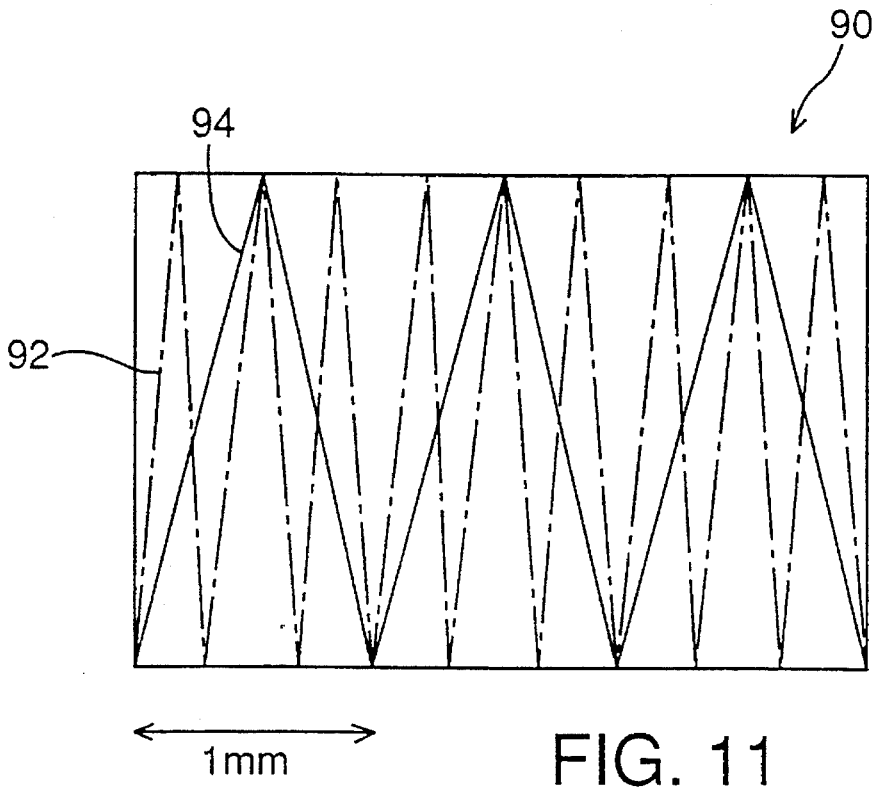
FIG. 11 is a view of another mixed-color block sewn with two color-different needle threads by the sewing machine of FIG. 1.

FIG. 10 shows a rectangular mixed-color block 80 sewn by the embroidery sewing machine of FIG. 1. The normal stitch density used to form underlying stitches 82 is four stitches per one mm, and the visible stitch density used to form overlying stitches 84 is two stitches per one mm. In this case, a portion of the stitch positions penetrated by the sewing needle to form the overlying stitches 84 are different from those penetrated to form the underlying stitches 82. The standard normal stitch density, 4 stitches per 1 mm, is changeable by using a density-change key (not shown) to a desired value, e.g., 6 stitches per 1 mm. In this particular case, as shown in FIG. 11, a mixed-color block 90 is sewn such that all the stitch positions penetrated by the sewing needle to form overlying stitches 94 coincide with a portion of those penetrated to form underlying stitches 92.

Figure 12:
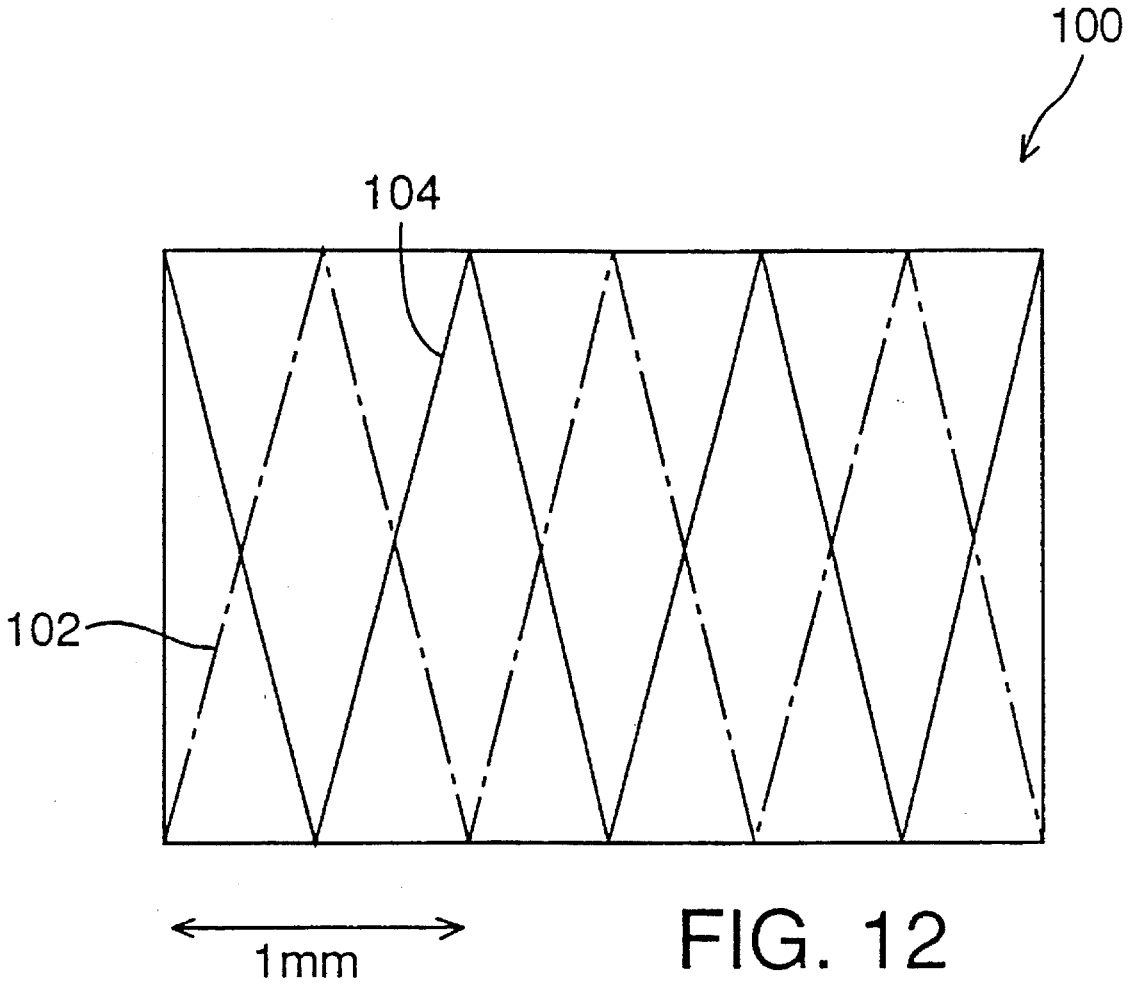
FIG. 12 is a view of yet another mixed-color block sewn with two color-different needle threads by the sewing machine of FIG. 1.

Furthermore, as shown in FIG. 12, it is possible to adapt the sewing machine of FIG. 1 to use a common stitch density to form both underlying stitches 102 and overlying stitches 104 in a mixed-color block 100. In this case, all the stitch positions penetrated by the sewing needle to form the overlying stitches 104 are different from the stitch positions penetrated to form the underlying stitches 102. However, the amount of a color thread used to form the overlying stitches 104 (i.e., number of the overlying stitches 104) is substantially equal to that of a different color thread used to form the underlying stitches 102 (i.e., number of the underlying stitches 102).

While the present invention has been described in its preferred embodiment, the present invention may otherwise be embodied.

Although the illustrated embodiment relates to a domestic sewing machine having a single sewing needle, the principle of the present invention may be applied to an industrial sewing machine having a plurality of sewing needles which carry a plurality of color-different needle threads, respectively, and each of which is automatically changeable (i.e., displaceable) and operable to form stitches with the color thread carried thereby according to needle-change data included in the sewing data. The needle-change data may be inputted or modified by the user. In these cases, the CPU 32 may automatically start the stitch-forming device 28 and the embroidery-frame displacing device 20 after a sewing needle has automatically changed with another sewing needle to form stitches with the color thread carried by the new needle.

While in the illustrated embodiment the embroidery-frame displacing device 20 is employed, it is possible to use a drive device for displacing the stitch-forming device 28 relative to the work sheet, or displacing both of the two elements relative to each other.

Although in the illustrated embodiment different sets of sewing data are used to form both underlying and overlying stitches in the mixed-color block 50*ab*, 50*ac*, 50*bc*, 80, 90, 100, a single and common set of sewing data may be used to form both underlying and overlying stitches in a mixed-color block. In this case, too, the hue of color of the mixed stitches formed in the mixed-color block may become different from that of each of the two color threads respectively used to form the underlying and overlying stitches, depending upon the angle of view of the user or others with respect to the work sheet or embroidery pattern.

Although in the illustrated embodiment a mixed-color block is embroidered with two color-different needle threads, it is possible to sew a mixed-color block with three or more sorts of color-different needle threads. In the case where the three needle threads, yellow, blue, and red, are used to form stitches on one another along a same line, the degree of brightness of the line is lowered and the hue of color of the line becomes grayish, which color may be utilized to define the outline of the embroidery pattern.

While in the illustrated embodiment the three needle threads, yellow, blue, and red, are used to produce the six colors, yellow, green, blue, violet, red, and orange, it is possible to use another combination of three color-different needle threads, i.e., yellow, magenta, and cyan that are widely used as three primary colors. In the latter case, the combination of the yellow and magenta threads provides a red color; the combination of the magenta and cyan threads provides blue; and the combination of the yellow and cyan threads provides green.

Furthermore, it is possible to produce various colors by changing the stitch density of overlying stitches formed over underlying stitches. In the case where a set of sewing data includes one or more sets of total stitch-number data each of which is indicative of a total number of mixed stitches formed of two color-different needle threads in a corresponding mixed-color block of an embroidery pattern, the sewing data may further include one or more sets of stitch-proportion data each of which is indicative of a proportion of a number of underlying stitches formed of one of the two needle threads in a corresponding mixed-color block, with respect to the total number of the mixed stitches, and/or one or more sets of stitch-proportion data each of which is indicative of a proportion of a number of overlying stitches formed of the other needle thread in the corresponding mixed-color block, with respect to the total number of the mixed stitches. Total stitch-number data may be stitch-density data commonly usable with each of one or more mixed-color blocks. The mixed-color-block stitch-density data are indicative of, e.g., one and half times as great a stitch density as that indicated by the "normal" stitch-density data. In this case, the stitch-proportion data included in the sewing data are indicative of, e.g., two thirds as the proportion of the underlying stitches, and/or one third as the proportion of the overlying stitches.

It is possible to prepare a user's personal card bearing a color table which shows the relationship between each of various color-different needle threads and respective colors obtained by combinations thereof with the other threads. Display data indicative of the color table may be prepared based on physical quantities of the colors of the needle threads, such as brightness, saturation, hue, and chromaticity, and may be stored in the internal ROM 34. The needle threads may be specified by inputting respective numbers given thereto. The sewing machine may be adapted such that, when the user specifies two particular threads by inputting the respective numbers given thereto, one for underlying stitches and the other for overlying stitches, the display 24 displays a color obtained by using the specified two threads to form the underlying and overlying stitches. Thus, the user can accurately select a desired color with improved work efficiency. Furthermore, when the user changes the standard "visible" stitch density of the overlying stitches, or the proportion (in terms of percent, for example) of the overlying stitches to the total number (100%) of the mixed stitches consisting of the underlying and overlying stitches, the display 24 may display a color corresponding to a changed visible stitch density or a changed proportion of the overlying stitches.

In the case where the user wishes to produce an embroidery pattern having a higher brightness than that of a selected needle thread, it is preferred to form underlying stitches with a while needle thread and subsequently form overlying stitches with the selected needle thread over the white-thread underlying stitches. The brightness of the thus formed embroidery pattern is higher than that of the embroidery pattern formed solely with the selected color thread. Meanwhile, in the case where the user wishes to produce an embroidery pattern having a sense of softness and/or having a curved profile, such as a glove, flower, cloud, animal, and bird, that is, pattern having a low saturation of color, it is preferred to use a plurality of color-different needle threads having similar hues of color. In this case, the degree of saturation of color may be lowered without largely changing the hue of color of the pattern as a whole, so that the pattern may be produced with improved reality.

Although in the illustrated embodiment overlying stitches are formed such that each overlying stitch extends substantially parallel to underlying stitches adjacent thereto, it is possible to form overlying stitches to extend in a direction different from a direction parallel to underlying stitches, e.g., perpendicular to the underlying stitches. In the latter case, the overlying stitches may give a stronger impression than the underlying stitches.

It is to be understood that the present invention may be embodied with other changes, improvements, and modifications that may occur to those skilled in the art without departing from the scope and spirit of the invention defined in the appended claims.

What is claimed is:

1. An embroidery sewing machine for producing an embroidery pattern in an embroidery area on a work sheet by filling the embroidery area with stitches, comprising:

a stitch-forming device including at least one sewing needle each of which carries a needle thread and reciprocates in an axial direction thereof, and a needle-thread catcher which cooperates with said at least one sewing needle to form said stitches into said work sheet;

a displacing device which displaces at least one of said stitch-forming device and said work sheet to form said stitches;

a data memory in which control data are stored, said control data comprising (a) first sewing data to control said stitch-forming device and said displacing device to form, with a first one of a plurality of color-different needle threads, first stitches at least a portion of which fill a predetermined portion of said embroidery area, and (b) second sewing data to control the stitch-forming device and the displacing device to form, with a second one of said plurality of color-different needle threads, second stitches at least a portion of which fill said predetermined portion of the embroidery area, so that the predetermined portion is seen to have a hue of color different from a hue of color of each of said color-different needle threads; and a control device which controls, according to said first and second sewing data, said stitch-forming device and said displacing device so that said predetermined portion of said embroidery area is filled with mixed stitches comprising said portion of said first stitches formed with said first one of said plurality of color-different needle threads and said portion of said second stitches formed with said second one of said plurality of color-different needle threads.

2. An embroidery sewing machine according to claim 1, wherein said control data stored in said data memory comprise said first and second sewing data to control said stitch-forming device and said displacing device so that underlying stitches as said portion of said first stitches are formed in said predetermined portion of said embroidery area with said first one of said plurality of color-different needle threads and subsequently overlying stitches as said portion of said second stitches are formed over said underlying stitches with said second one of said plurality of color-different needle threads such that said underlying stitches are seen through said overlying stitches.

3. An embroidery sewing machine according to claim 1, wherein said control data stored in said data memory comprise said first and second sewing data to control said stitch-forming device and said displacing device so that underlying stitches as said portion of said first stitches are formed in said predetermined portion of said embroidery area with said first one of said plurality of color-different needle threads and subsequently overlying stitches as said portion of said second stitches are formed over said underlying stitches with said second one of said plurality. Of color-different needle threads such that an amount of said second one of said plurality of color-different needle threads used to form said overlying stitches is less than an amount of said first one of said plurality of color-different needle threads used to form said underlying stitches.

4. An embroidery sewing machine according to claim 1, wherein said control data stored in said data memory comprise said first and second sewing data to control said stitch-forming device and said displacing device so that underlying stitches as said portion of said first stitches are formed in said predetermined portion of said embroidery area with said first one of said plurality of color-different needle threads and subsequently overlying stitches as said portion of said second stitches are formed over said underlying stitches with said second one of said plurality of color-different needle threads such that said overlying stitches are formed by penetrating, with said sewing needle, stitch positions at least a portion of which are different from stitch positions penetrated to form said underlying stitches.

5. An embroidery sewing machine according to claim 4, wherein said control device comprises means for controlling said stitch-forming device and said displacing device such that an amount of said second needle thread used to form said overlying stitches is substantially equal to an amount of said first needle thread used to form said underlying stitches.

6. An embroidery sewing machine according to claim 1, wherein said first and second sewing data of said control data stored in said data memory comprise common sewing data to control said stitch-forming device and said displacing device to form said portion of said first stitches in said predetermined portion of said embroidery area with said first one of said plurality of color-different needle threads and control said stitch-forming device and said displacing device to form said portion of said second stitches in said predetermined portion of said embroidery area with said second one of said plurality of color-different needle threads.

7. An embroidery sewing machine according to claim 1, wherein said first sewing data of said control data stored in said data memory comprise at least a portion thereof to control said stitch-forming device and said displacing device to form said portion of said first stitches in said predetermined portion of said embroidery area with said first one of said plurality of color-different needle threads, and said second sewing data comprise at least a portion thereof to control said stitch-forming device and said displacing device to form said portion of said second stitches in said predetermined portion of said embroidery area with said second one of said plurality of color-different needle threads, said respective portions of said first and second sewing data being different from each other.

8. An embroidery sewing machine according to claim 1, wherein said control device comprises color changing means for changing said first one of said plurality of color-different needle threads to said second one of said plurality of color-different needle threads, said control data comprising color-change command data to operate said color changing means.

9. An embroidery sewing machine according to claim 8, wherein said color changing means comprises stopping means for stopping said stitch-forming device and said displacing device, said color-change command data comprising stop command data to operate said stopping means to stop said stitch-forming device and said displacing device so as to permit said first one of said plurality of color-different needle threads to be changed to said second one of said plurality of color-different needle threads.

10. An embroidery sewing machine according to claim 9, wherein said color changing means further comprises a display device, said color-change command data further comprising display command data to operate said display device to indicate that it is necessary to change said needle thread carried by said sewing needle.

11. An embroidery sewing machine according to claim 8, wherein said color changing means comprises starting means for starting said stitch-forming device and said displacing device after said first one of said plurality of color-different needle threads has been changed to said second one of said plurality of color-different needle threads.

12. An embroidery sewing machine according to claim 11, wherein said color changing means further comprises a manually operable device which is manually operable to operate said starting means to start said stitch-forming device and said displacing device.

13. An embroidery sewing machine according to claim 1, wherein said control data stored in said data memory comprise at least two of (a) first thread-amount data indicative of a first amount of said first one of said plurality of color-different needle threads used to form underlying stitches as said portion of said first stitches in said predetermined portion of said embroidery area, (b) second thread-amount data indicative of a second amount of said second one of said plurality of color-different needle threads used to form overlying stitches as said portion of said second stitches over said underlying stitches in said predetermined portion of said embroidery area, and (c) total thread-amount data indicative of a total amount of said first one and second one of said plurality of color-different needle threads used to form said mixed stitches consisting of said underlying stitches and said overlying stitches.

14. An embroidery sewing machine according to claim 13, wherein said second amount is less than said first amount.

15. An embroidery sewing machine according to claim 13, wherein said control data stored in said data memory comprise said first and second thread-amount data, said first thread-amount data comprising first stitch-density data indicative of a first number of said underlying stitches formed in a unit length, said second thread-amount data comprising second stitch-density data indicative of a second number of said overlying stitches formed in said unit length.

16. An embroidery sewing machine according to claim 13, wherein said control data stored in said data memory comprise said first and second thread-amount data, said first thread-amount data comprising first stitch-density data indicative of a first pitch of formation of said underlying stitches, said second thread-amount data comprising second stitch-density data indicative of a second pitch of formation of said overlying stitches.

17. An embroidery sewing machine according to claim 13, wherein said control data stored in said data memory comprise said first and second thread-amount data, said first thread-amount data comprising first stitch-number data indicative of a first number of said underlying stitches formed in said predetermined portion of said embroidery area, said second thread-amount data comprising second stitch-number data indicative of a second number of said overlying stitches formed in said predetermined portion of said embroidery area.

18. An embroidery sewing machine according to claim 14, wherein said control data stored in said data memory comprise said total thread-amount data and at least one of said first and second thread-amount data, said at least one of said first and second thread-amount data comprising at least one of (a) first thread-proportion data indicative of a first proportion of said first amount of said first one of said plurality of color-different needle threads with respect to said total amount of said first one and second one of said plurality of color-different needle threads and (b) second thread-proportion data indicative of a second proportion of said second amount of said second one of said plurality of color-different needle threads with respect to said total amount of said first one and second one of said plurality of color-different needle threads.

19. An embroidery sewing machine according to claim 13, wherein said control data stored in said data memory comprise said first and second thread-amount data and outline data indicative of an outline of said predetermined portion of said embroidery area, said control device comprising means for producing, according to said outline data and each of said first and second thread-amount data, stitch position data indicative of stitch positions which are penetrated by said sewing needle to form corresponding ones of said underlying stitches and said overlying stitches.

20. An embroidery sewing machine according to claim 19, wherein said control data stored in said data memory comprise first same-color area data indicative of an outline of a first same-color area which is filled with stitches formed of said first one of said plurality of color-different needle threads and second same-color area data indicative of an outline of a second same-color area which overlaps said first same-color area inside an outline of said embroidery area and which is filled with stitches formed of said second one of said plurality of color-different needle threads, the overlapping portion of said second same-color area corresponding to said predetermined portion of said embroidery area, said outline data being indicative of an outline of said overlapping portion of said second same-color area.

21. An embroidery sewing machine according to claim 20, wherein each of said first and second same-color area data comprises data indicative of whether a corresponding one of said first and second same-color areas includes an overlapping portion which overlaps another same-color area inside said outline of said embroidery area.

22. An embroidery sewing machine according to claim 13, further comprising a thread-amount-data input device which is operable to input at least one of said first, second and total thread-amount data.

23. An embroidery sewing machine according to claim 22, wherein said thread-amount input device comprises a thread-amount-data modifying device which is operable to modify said second thread-amount data.

24. An embroidery sewing machine according to claim 22, further comprising a data storing device which stores, in said data memory, said control data including said at least one of said first, second and total thread-amount data inputted by operating said thread-amount-data input device.

25. An embroidery sewing machine according to claim 24, wherein said data storing device comprises a manually operable device which is manually operable to store, in said data memory, said control data including said at least one of said first, second and total thread-amount data inputted by operating said thread-amount-data input device.

26. An embroidery sewing machine according to claim 13, wherein said control data stored in said data memory comprise direction data, said control device comprising means for controlling, according to said direction data, said stitch-forming device and said displacing device to form said overlying stitches each of which extends parallel to the underlying stitches adjacent to said each overlying stitch.

27. An embroidery sewing machine according to claim 13, wherein said control data stored in said data memory comprise said second thread-amount data, said second thread-amount data comprising variable-stitch-density data, said control device comprising means for controlling, according to said variable-stitch-density data, said stitch-forming device and said displacing device to form said overlying stitches such that a stitch density of the overlying stitches varies in said predetermined portion of said embroidery area.

28. An embroidery sewing machine according to claim 27, wherein said variable-stitch-density data stored in said data memory comprise gradation data to control said stitch-forming device and said displacing device to form said overlying stitches such that said stitch density of the overlying stitches gradually varies as the overlying stitches are formed over said underlying stitches in said predetermined portion of said embroidery area.

29. A process of producing an embroidery pattern in an embroidery area on a work sheet by filling the embroidery area with stitches, comprising the steps of:

storing, in a data memory, control data comprising (a) first sewing data to control an embroidery sewing machine to form, with a first one of a plurality of color-different needle threads, first stitches at least a portion of which fill a predetermined portion of said embroidery area, and (b) second sewing data to control said sewing machine to form, with a second one of said plurality of color-different needle threads, second stitches at least a portion of which fill said predetermined portion of the embroidery area, so that said predetermined portion is seen to have a hue of color different from a hue of color of each of said color-different needle threads, and controlling said sewing machine according to said first and second sewing data so that said predetermined portion of said embroidery area is filled with mixed stitches comprising said portion of said first stitches formed with said first one of said plurality of color-different needle threads and said portion of said second stitches formed with said second one of said plurality of color-different needle threads, so as to produce said embroidery pattern on said work sheet by filling said embroidery area with said stitches comprising said mixed stitches.

30. A process according to claim 29, wherein the step of controlling said sewing machine comprising controlling a color changing device of the sewing machine, to change said first one of said plurality of color-different needle threads to said second one of said plurality of color-different needle threads according to color-change command data contained in said control data.

31. A process according to claim 29, wherein the step of storing said control data comprising storing in said data memory said control data comprising at least two of (a) first thread-amount data indicative of a first amount of said first one of said plurality of color-different needle threads used to form underlying stitches as said portion of said first stitches in said predetermined portion of said embroidery area, (b) second thread-amount data indicative of a second amount of said second one of said plurality of color-different needle threads used to form overlying stitches as said portion of said second stitches over said underlying stitches in said predetermined portion of said embroidery area, and (c) total thread-amount data indicative of a total amount of said first one and second one of said plurality of color-different needle threads used to form said mixed stitches including said underlying stitches and said overlying stitches.

32. A process according to claim 31, wherein the step of storing said control data comprises storing in said data memory said control data comprising said first and second thread-amount data and outline data indicative of an outline of said predetermined portion of said embroidery area, and the step of producing said embroidery pattern comprises producing, according to said outline data and each of said first and second thread-amount data, stitch position data indicative of stitch positions which are penetrated by at least one sewing needle of said embroidery sewing machine to form corresponding ones of said underlying stitches and said overlying stitches.

33. A process according to claim 31, wherein the step of producing said embroidery pattern comprises inputting, by operating a thread-amount-data input device, at least one of said first, second and total thread-amount data.

34. A process according to claim 31, wherein the step of storing said control data comprises storing in said data memory said control data comprising direction data, and the step of producing said embroidery pattern comprises controlling, according to said direction data, said embroidery sewing machine to form said overlying stitches each of which extends parallel to the underlying stitches adjacent to said each overlying stitch.

35. An apparatus for producing control data to control an embroidery sewing machine and utilizing the control data to form an embroidery pattern in an embroidery area on a work sheet by filling the embroidery data with stitches, comprising:

a data producing device which produces said control data comprising (a) first sewing data to control said sewing machine to form, with a first one of a plurality of color-different needle threads, first stitches at least a portion of which fill a predetermined portion of said embroidery area, and (b) second sewing data to control the sewing machine to form, with a second one of said plurality of color-different needle threads, second stitches at least a portion of which fill said predetermined portion of the embroidery data, so that said predetermined portion is seen to have a hue of color different from a hue of color of each of said color-different needle threads;

a data memory in which said control data are stored; and a data utilizing device which utilizes said control data so that said predetermined portion of said embroidery area is filled with mixed stitches comprising said portion of said first stitches formed with said first one of said plurality of color-different needle threads and said portion of said second stitches formed with said second one of said plurality of color-different needle threads.

36. An apparatus according to claim 35, wherein said data utilizing device comprises a stitch-forming device of said embroidery sewing machine which forms said mixed stitches according to said control data.

37. An apparatus according to claim 35, wherein said data utilizing device comprises an external memory in which said control data are stored.

38. An apparatus according to claim 37, wherein said external memory comprises a random access memory card which is removable from the apparatus for use with said embroidery sewing machine independent of the apparatus.

* * * * *